US010981391B2

(12) United States Patent
Oya et al.

(10) Patent No.: US 10,981,391 B2
(45) Date of Patent: Apr. 20, 2021

(54) LIQUID CONTAINER AND LIQUID EJECTING APPARATUS

(71) Applicant: SEIKO EPSON CORPORATION, Tokyo (JP)

(72) Inventors: Shun Oya, Kiso-machi (JP); Yoshihiro Koizumi, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/681,456

(22) Filed: Nov. 12, 2019

(65) Prior Publication Data

US 2020/0147974 A1 May 14, 2020

(30) Foreign Application Priority Data

Nov. 13, 2018 (JP) ..... JP2018-212960

(51) Int. Cl.
*B41J 2/175* (2006.01)
*B41J 2/14* (2006.01)
*B41J 2/195* (2006.01)

(52) U.S. Cl.
CPC ..... *B41J 2/17556* (2013.01); *B41J 2/14* (2013.01); *B41J 2/195* (2013.01); *B41J 2002/14403* (2013.01)

(58) Field of Classification Search
CPC ..... B41J 2/17556; B41J 2/17553; B41J 2/17513; B41J 2/17503; B41J 2/17506; B41J 2/17509; B41J 2/1752; B41J 2/17523; B41J 2/17533; B41J 2/17543
See application file for complete search history.

(56) References Cited

U.S. PATENT DOCUMENTS

2001/0038405 A1 11/2001 Ishizawa et al.
2013/0201260 A1 8/2013 Aoki et al.
2014/0168326 A1 6/2014 Nariai et al.

FOREIGN PATENT DOCUMENTS

JP S60-240456 A 11/1985
JP 2001-293882 A 10/2001
JP 2001-328272 A 11/2001
JP 2013-022934 A 2/2013

*Primary Examiner* — Kristal Feggins
(74) *Attorney, Agent, or Firm* — Oliff PLC

(57) ABSTRACT

In a state in which a liquid storage body is installed in a liquid ejecting apparatus, at least part of the upper edge of a liquid storage section and at least part of the lower edge of the liquid storage section are in contact with a case and a first inner surface of the liquid storage section and its second inner surface opposite to the first inner surface are separated from each other. The liquid storage section is structured so that as a liquid is supplied, the first inner surface and second inner surface gradually approach each other and, at the same time, come into contact with each other from top to bottom, forming, at the bottom of the interior of the liquid storage section, a liquid flow path through which the liquid flows from the liquid storage section to the liquid supply section.

9 Claims, 14 Drawing Sheets

FIG. 12

| FILM LENGTH RATIO | | AMOUNT OF REMAINING INK | | DEFORMED STATE | |
|---|---|---|---|---|---|
| BLACK | COLOR | BLACK | COLOR | BLACK | COLOR |
| 0.81 | 0.93 | – | B | – | U-SHAPE |
| 0.88 | 1.02 | – | B | – | U-SHAPE |
| 0.93 | 1.07 | – | B | – | U-SHAPE |
| 0.94 | 1.09 | B | – | U-SHAPE | – |
| 0.98 | 1.13 | A | A | S-SHAPE | S-SHAPE |
| 1.02 | 1.17 | A | A | S-SHAPE | S-SHAPE |
| 1.06 | 1.23 | A | A | S-SHAPE | S-SHAPE |
| 1.15 | 1.33 | A | B | S-SHAPE | S-SHAPE AND WRINKLES |

LIQUID CONTAINER AND LIQUID EJECTING APPARATUS

The present application is based on, and claims priority from JP Application Serial Number 2018-212960, filed Nov. 13, 2018, the disclosure of which is hereby incorporated by reference herein in its entirety.

BACKGROUND

1. Technical Field

The present disclosure relates to a liquid container and a liquid ejecting apparatus.

2. Related Art

In known technologies to increase the efficiency of using an ink in an ink cartridge, an ink path through which the ink passes is formed in an ink pack accommodated in the ink cartridge. In JP-A-2001-293882, for example, a tight-contact preventing member is provided in an ink pack to prevent both inner surfaces of the ink pack from coming from tight contact with each other. Due to the tight-contact preventing member, an ink flow path is formed. In JP-A-2001-328272, an ink path is formed by expanding part of an ink pack toward the outside by press-molding.

In the technologies described above, however, ink may be left in the ink path formed by the tight-contact preventing member or by press-molding. Therefore, there is a demand for a technology that can reduce the amount of liquid remaining in a liquid container without using a tight-contact preventing member or performing press-molding.

SUMMARY

A first aspect of the present disclosure provides a liquid container from which a liquid can be supplied to a liquid ejecting head in a liquid ejecting apparatus. This liquid container has a liquid storage body that stores the liquid and also has a case that stores the liquid storage body. The liquid storage body has a liquid storage section formed like a bag by joining the edges of opposing films together and also has a liquid supply section that can supply the liquid from the interior of the liquid storage section to its outside. In a state in which the liquid storage section is filled with the liquid and the liquid storage body is installed in the liquid ejecting apparatus, at least part of the upper edge of the liquid storage section and at least part of the lower edge of the liquid storage section are in contact with the case and a first inner surface of the liquid storage section and its second inner surface opposite to the first inner surface are separated from each other. The liquid storage section is structured so that as the liquid is supplied, the first inner surface and second inner surface gradually approach each other and, at the same time, come into contact with each other from top to bottom, forming, at the bottom of the interior of the liquid storage section, a liquid flow path through which the liquid flows from the liquid storage section to the liquid supply section.

A second aspect of the present disclosure provides a liquid ejecting apparatus. This liquid ejecting apparatus has the liquid container in the above aspect and a liquid ejecting head that ejects the liquid supplied from the liquid container.

BRIEF DESCRIPTION OF THE DRAWINGS

FIG. 12 indicates preferable relationships of dimensions that a film and a case take.

DESCRIPTION OF EXEMPLARY EMBODIMENTS

A. First Embodiment

Figure 1:
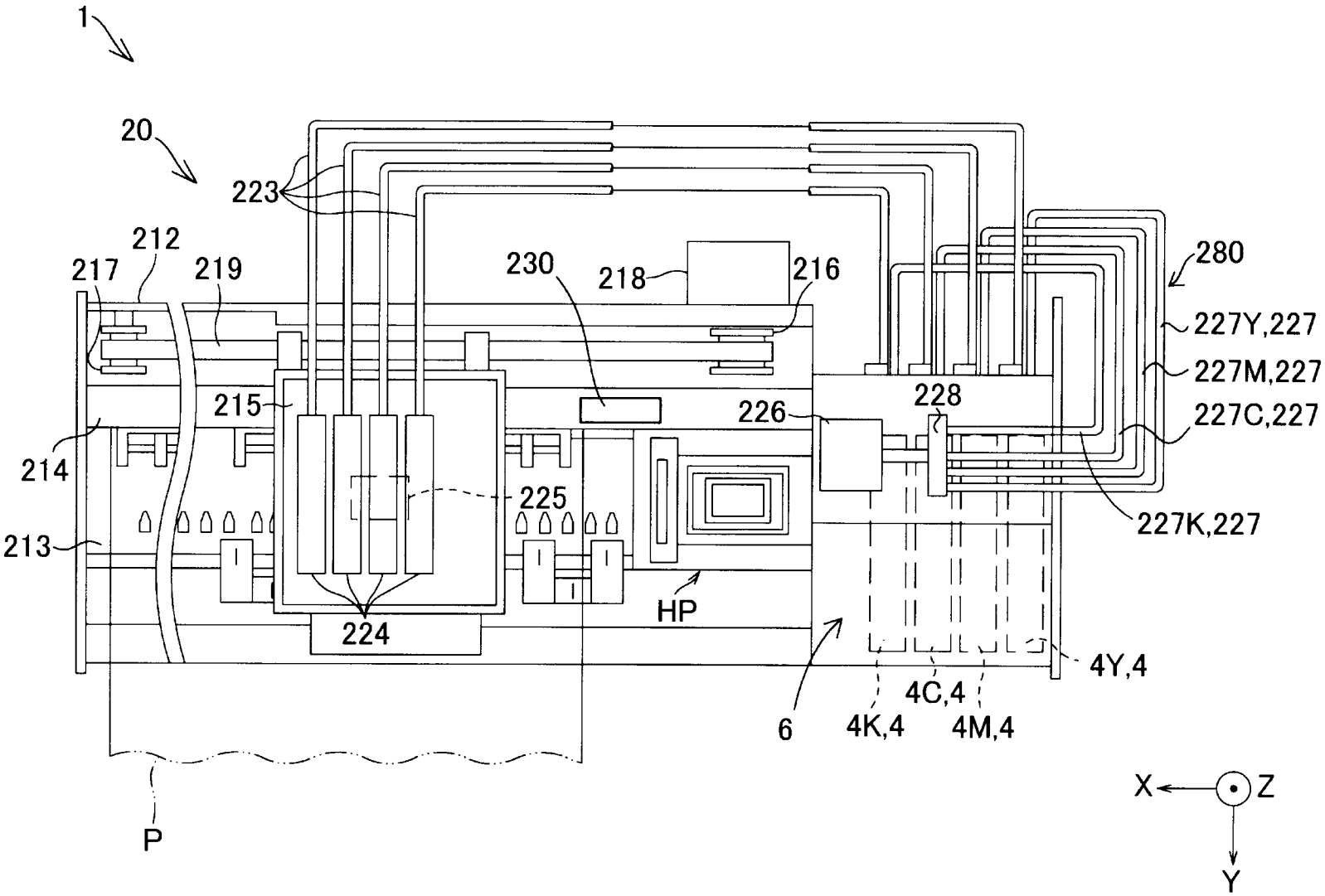
FIG. 1 schematically illustrates the structure of a liquid ejecting system.

FIG. 1 schematically illustrates the structure of a liquid ejecting system 1 in a first embodiment of the present disclosure. In FIG. 1, the X-axis, Y-axis, and Z-axis, which are three spatial axes orthogonal to one another, are drawn. The arrows of the X-axis, Y-axis, and Z-axis respectively indicate positive directions along the X-axis, Y-axis, and Z-axis. The positive directions along the X-axis, Y-axis, and Z-axis are respectively referred to as the +X direction, +Y direction, and +Z direction. Directions opposite to the directions indicated by the arrows of the X-axis, Y-axis, and Z-axis are negative directions along the X-axis, Y-axis, and Z-axis. The negative directions along the X-axis, Y-axis, and Z-axis are respectively referred to as the −X direction, −Y direction, and −Z direction. When it does not matter whether directions along the X-axis, Y-axis, and Z-axis are positive or negative, these directions are respectively referred to simply as the X-direction, Y-direction, and Z-direction. These are also true for the drawings referred below and the descriptions given below. The directions of the X-axis, Y-axis, and Z-axis indicated in the drawings other than FIG. 1 match the directions of the X-axis, Y-axis, and Z-axis in FIG. 1. In this embodiment, the Z axis is an axis along the direction of the force of gravity or the vertical direction and the −Z direction is the direction of the force of gravity or the vertical direction.

The liquid ejecting system 1 has a printer 20 as a liquid ejecting apparatus and also has four cartridges denoted 4C, 4M, 4Y, and 4K as liquid containers. The printer 20 is an ink jet printer that ejects an ink used as a liquid from a recording head 225 used as a liquid ejecting head. When the four cartridges 4C, 4M, 4Y, and 4K are referred to without a distinction, they will be assigned reference numeral 4. In a state in which the liquid ejecting system 1 and printer 20 are in use, the +Z direction is upward in the vertical direction and the −Z direction is downward in the vertical direction.

The state in which the liquid ejecting system 1 and printer 20 are in use refers to a state in which the liquid ejecting system 1 is installed on a horizontal installation surface defined by the X direction and Y direction.

The printer 20 has a main case 212 shaped like a substantially rectangular box and also has a controller 230 disposed in the main case 212. The controller 230 controls the printing operation of the printer 20 and other various operations and transmits and receives signals to and from the cartridges 4.

In the main case 212, a platen 213 is disposed so as to be along the X direction, which is the longitudinal direction of the main case 212. The platen 213 is a pedestal that supports recoding paper P, which is a target to which ejection is directed. On the platen 213, the recoding paper P is supplied by a paper feed mechanism (not illustrated) along a sub-scanning direction orthogonal to a main scanning direction. In this embodiment, the main scanning direction is the X direction and the sub-scanning direction is the Y direction.

The printer 20 further has a guide shaft 214, a carriage 215, a driving pulley 216, a driven pulley 217, and a carriage motor 218.

The guide shaft 214 is positioned more on the +Z direction side than is the platen 213. The guide shaft 214 is a rod-like member along the main scanning direction. The carriage 215 is supported by the guide shaft 214 so as to be movable along the guide shaft 214.

The driving pulley 216 and driven pulley 217 are rotatably disposed at positions corresponding to both ends of the guide shaft 214, the positions being more on the −Y direction side than is the guide shaft 214. The carriage motor 218 is linked to the driving pulley 216. An endless timing belt 219 that supports the carriage 215 is passed between the driving pulley 216 and the driven pulley 217. When driven by the carriage motor 218, therefore, the carriage 215 can move bidirectionally in the main scanning direction along the guide shaft 214. Although, in this embodiment, the recording head 225 is structured so that it can move bidirectionally in the main scanning direction, this is not a limitation. For example, the recording head 225 may be a line head that extends along the X direction and the position of which is fixed.

The printer 20 further has a cartridge installation section 6 in which the cartridges 4 are detachably installed. The cartridge installation section 6 is also referred to as the holder. The cartridge installation section 6 is disposed inside the main case 212. The main case 212 is structured so that part of it can be opened and closed. When this openable and closable part is opened, the cartridge 4 can be attached to and detached from the cartridge installation section 6. Although, in this embodiment, the cartridge installation section 6 is disposed inside the main case 212, this is not a limitation. For example, the whole or part of the cartridge installation section 6 may be outside the main case 212.

The cartridge installation section 6 detachably accommodates the four cartridges 4C, 4M, 4K, and 4Y. The cartridge 4K stores a black ink. The cartridge 4C stores a cyan ink. The cartridge 4M stores a magenta ink. The cartridge 4Y stores a yellow ink. Each type of ink is a pigmented ink that includes pigment particles and a dispersant such as water. The printer 20 has four liquid flow paths 223 in correspondence to the four cartridges 4C, 4M, 4Y, and 4K. Each liquid flow path 223 is a tube. Each liquid flow path 223 makes the relevant cartridge 4 and recording head 225 communicate with each other.

When installed in the cartridge installation section 6, the cartridge 4 is coupled to the upstream end of the relevant liquid flow path 223. The downstream end of the liquid flow path 223 is coupled to the upstream end of a valve unit 224 mounted on the carriage 215. The downstream side of the valve unit 224 is coupled to the recording head 225 disposed on the lower surface of the carriage 215. That is, the ink stored in the cartridge 4 passes through the liquid flow path 223 and into the recording head 225.

A home position HP, to which the recording head 225 is retracted, is provided between the cartridge installation section 6 and the platen 213. At this home position HP, various types of maintenance processing such as cleaning are performed for the recording head 225 before printing starts.

The printer 20 further has a pressuring mechanism 280 that supplies a pressurized fluid to each cartridge 4. The pressuring mechanism 280 is disposed inside the main case 212. The pressuring mechanism 280 has a pressurizing pump 226, from which pressurized air is supplied as the pressurized fluid, and a plurality of fluid flow paths 227, through which the pressurized air is supplied to the cartridges 4.

The pressurizing pump 226 is coupled to the upstream ends of the fluid flow paths 227. Each fluid flow path 227 is a tube. The fluid flow paths 227 branch from a distributor 228 provided at the downstream of the pressurizing pump 226. The downstream end of each branching fluid flow path 227 is coupled to the relevant cartridge 4. There are four fluid flow paths 227, which are liquid fluid flow paths 227K, 227C, 227M, and 227Y so as to correspond to the four cartridges 4. The controller 230 controls the operation of the pressurizing pump 226 to supply the pressurized fluids to the cartridges 4 through the fluid flow paths 227.

Each fluid flow path 227 allows a flow of pressurized air used to supply the ink stored in the relevant cartridge 4 to the recording head 225. The liquid fluid flow paths 227K, 227C, 227M, and 227Y allow pressurized air to flow into pressurizing chambers, which will be described later, in the cartridges 4. Thus, a liquid storage section stored in each cartridge 4 is pressed. When the liquid storage section is pressed, the ink passes through the liquid flow path 223 and into the recording head 225.

Although, in this embodiment, a single pressurizing pump 226 common to the liquid fluid flow paths 227K, 227C, 227M, and 227Y is used to supply pressurized air to them, this is not a limitation. For example, a plurality of pressurizing pumps 226 may be provided in correspondence to the liquid fluid flow paths 227K, 227C, 227M, and 227Y.

Figure 2:
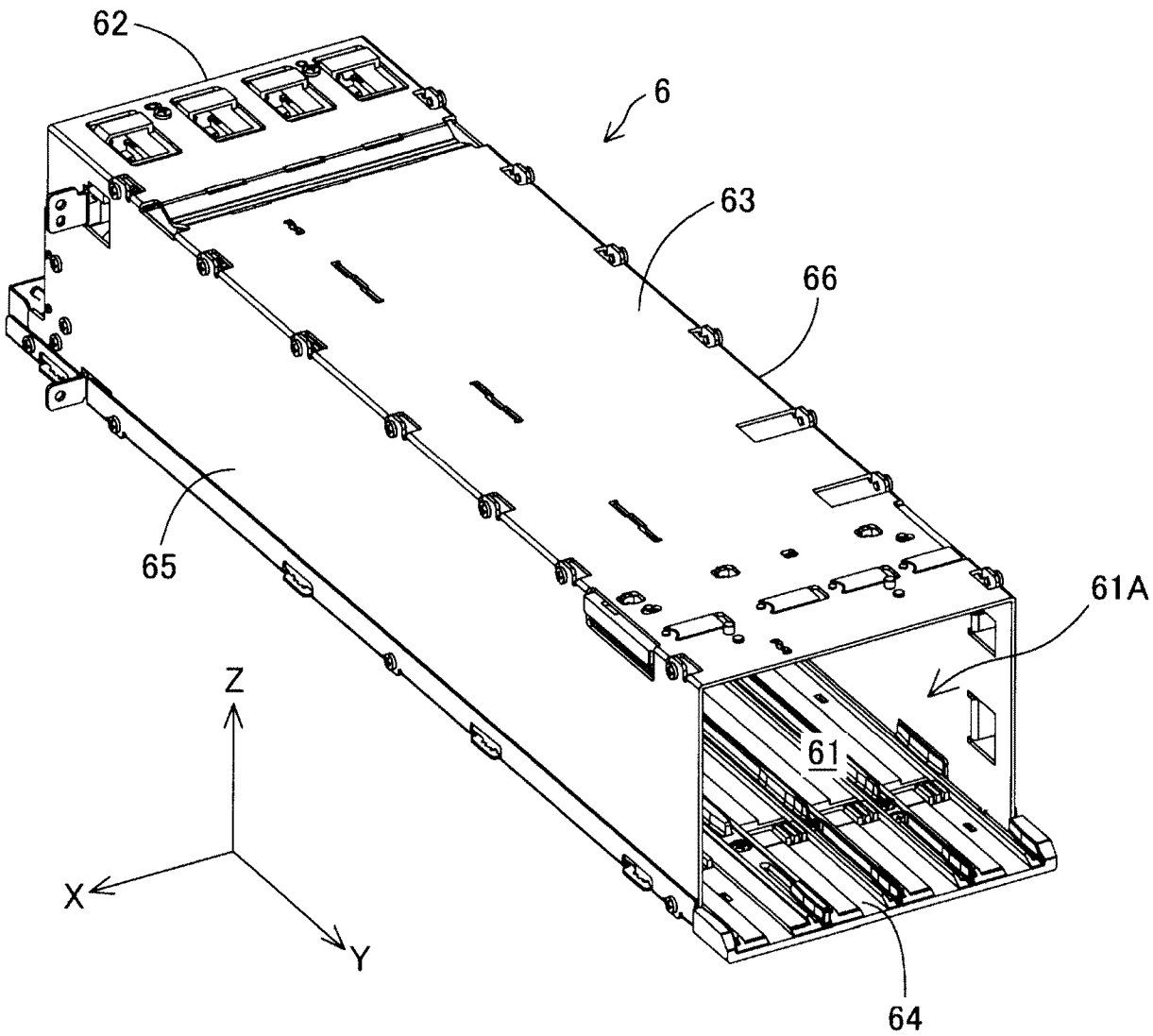
FIG. 2 is a perspective view illustrating the outside shape of a cartridge installation section.
Figure 3:
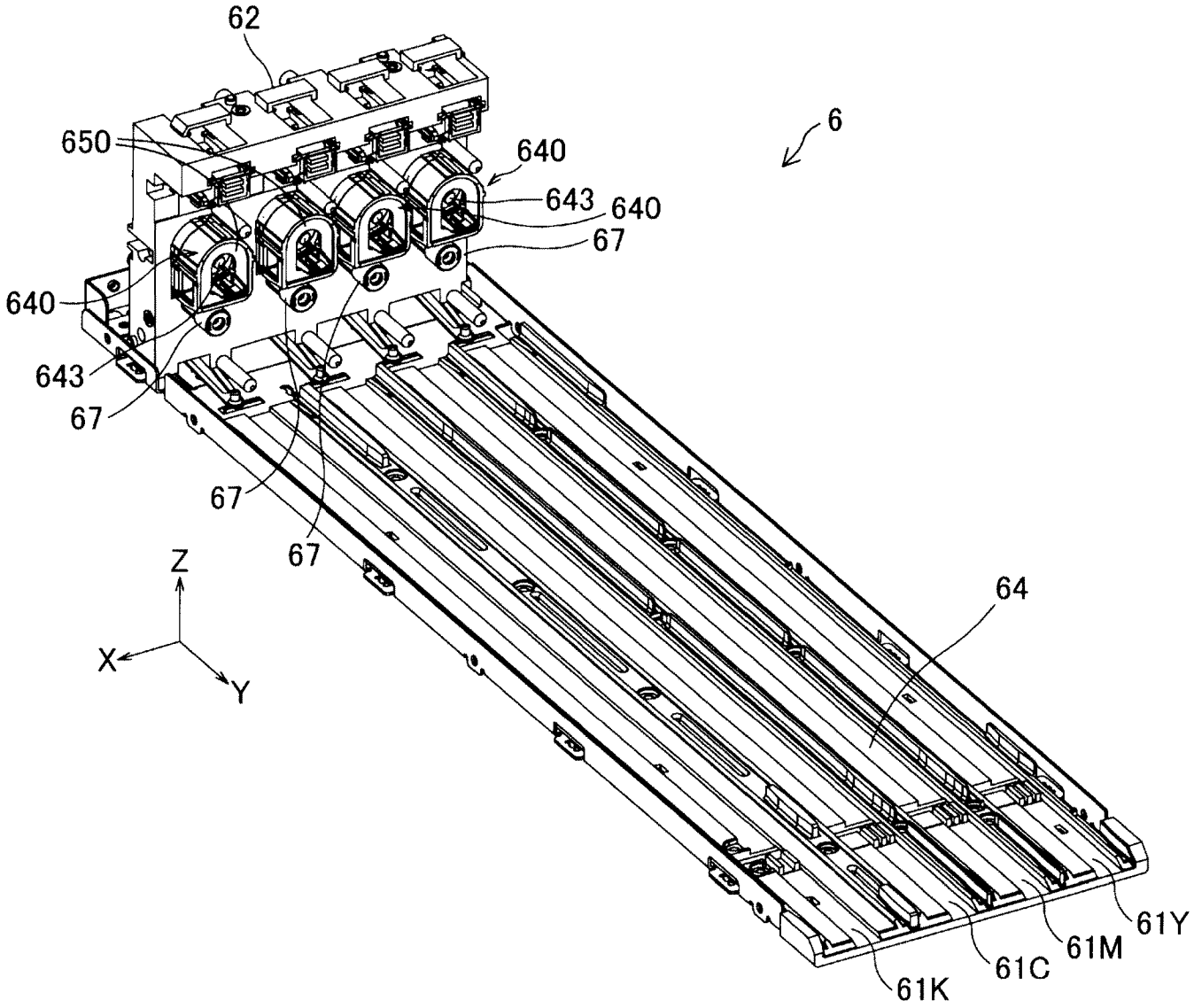
FIG. 3 is another perspective view illustrating the outside shape of the cartridge installation section.

FIG. 2 is a perspective view illustrating the outside shape of the cartridge installation section 6. FIG. 3 is another perspective view illustrating the outside shape of the cartridge installation section 6. In FIG. 3, part of the structure of the cartridge installation section 6 is omitted so that the interior of the cartridge installation section 6 can be viewed. Each cartridge 4 is installed in the cartridge installation section 6 in the −Y direction and is detached from the cartridge installation section 6 in the +Y direction.

As illustrated in FIG. 2, a cartridge storage chamber 61 in which the cartridges 4 are accommodated is formed in the cartridge installation section 6 from six wall portions described later. The cartridge storage chamber 61 is shaped like a substantially rectangular parallelepiped. The cartridge storage chamber 61 includes four portions in each of which one of the four cartridges 4C, 4M, 4Y, and 4K is accommodated. Each portion is also referred to as a slot. Specifically, as illustrated in FIG. 3, the portion in which the cartridge 4K is accommodated is referred to as the slot 61K, the portion in which the cartridge 4C is accommodated is referred to as the slot 61C, the portion in which the cartridge 4M is accommodated is referred to as the slot 61M, and the portion in which the cartridge 4Y is accommodated is referred to as the slot 61Y.

The cartridge installation section 6 has an apparatus-side front wall portion 62, a first apparatus-side side wall portion 63, and a second apparatus-side side wall portion 64. The cartridge installation section 6 also has a third apparatus-side side wall portion 65 and a fourth apparatus-side side wall portion 66. The cartridge storage chamber 61 is defined by these five wall portions 62, 63, 64, 65, and 66. The outside shape of each of the five wall portions 62, 63, 64, 65, and 66 is substantially rectangular. The cartridge storage chamber 61 has an opening 61A at a position opposite to the apparatus-side front wall portion 62.

As illustrated in FIGS. 2 and 3, the apparatus-side front wall portion 62 is positioned more on the −Y direction side than is the cartridge storage chamber 61. When the printer 20 is in use, the apparatus-side front wall portion 62 is a perpendicular wall portion.

As illustrated in FIG. 3, the cartridge installation section 6 has a liquid supply mechanism 640 and a liquid supply pressurizing section 67. The liquid supply mechanism 640 and liquid supply pressurizing section 67 are disposed in the apparatus-side front wall portion 62. One liquid supply mechanism 640 and one liquid supply pressurizing section 67 are provided for each of the slots 61C, 61M, 61Y, and 61K in correspondence to each of the cartridges 4C, 4M, 4Y, and 4K.

The liquid supply mechanism 640 has a cover member 650 and a liquid entrance 643. The liquid entrance 643 is used to allow the ink in the cartridge 4 to flow into the printer 20. The liquid entrance 643 is like a tube having a central axis extending along the Y direction. The liquid entrance 643 is coupled to the cartridge 4.

The cover member 650 encloses the periphery of the liquid entrance 643 about the central axis of the liquid entrance 643. The cover member 650 reduces the possibility that ink scatters to the outside when the cartridge 4 is attached or detached. The cover member 650 is urged in the +Y direction by an urging member (not illustrated), such as a coil spring, included in the liquid supply mechanism 640. The cover member 650 is structured so as to be movable along the Y direction. In the attachment of the cartridge 4, the cartridge 4 abuts the cover member 650. Then, the cover member 650 moves in the −Y direction against the urging force of the urging member. Thus, the end of the liquid entrance 643 on the +Y direction side protrudes from the cover member 650 in the +Y direction and is coupled to the cartridge 4.

The liquid supply pressurizing section 67 is a tubular member through which pressurized air flows, the pressurized air being a pressurized fluid that supplies the ink in the cartridge 4 to the recording head 225. The liquid supply pressurizing section 67 is coupled to the downstream end of the liquid fluid flow path 227K, 227C, 227M, or 227Y, whichever is applicable. With the cartridge 4 installed, the liquid supply pressurizing section 67 is coupled to the cartridge 4. A tubular seal member is provided on the inner circumferential surface of the liquid supply pressurizing section 67. This seal member is formed from, for example, rubber.

Figure 4:
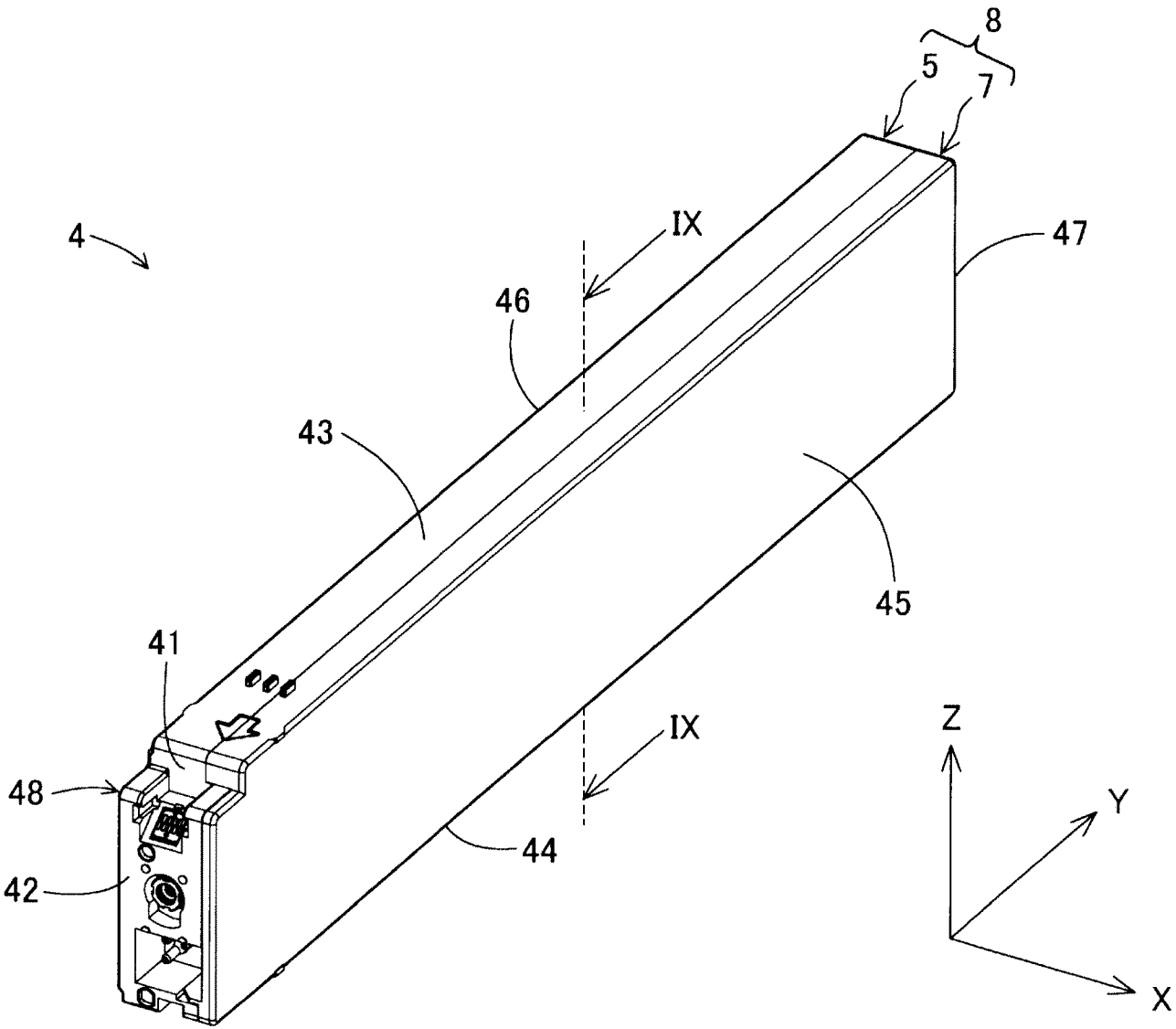
FIG. 4 is perspective view illustrating the outside shape of a cartridge.
Figure 5:
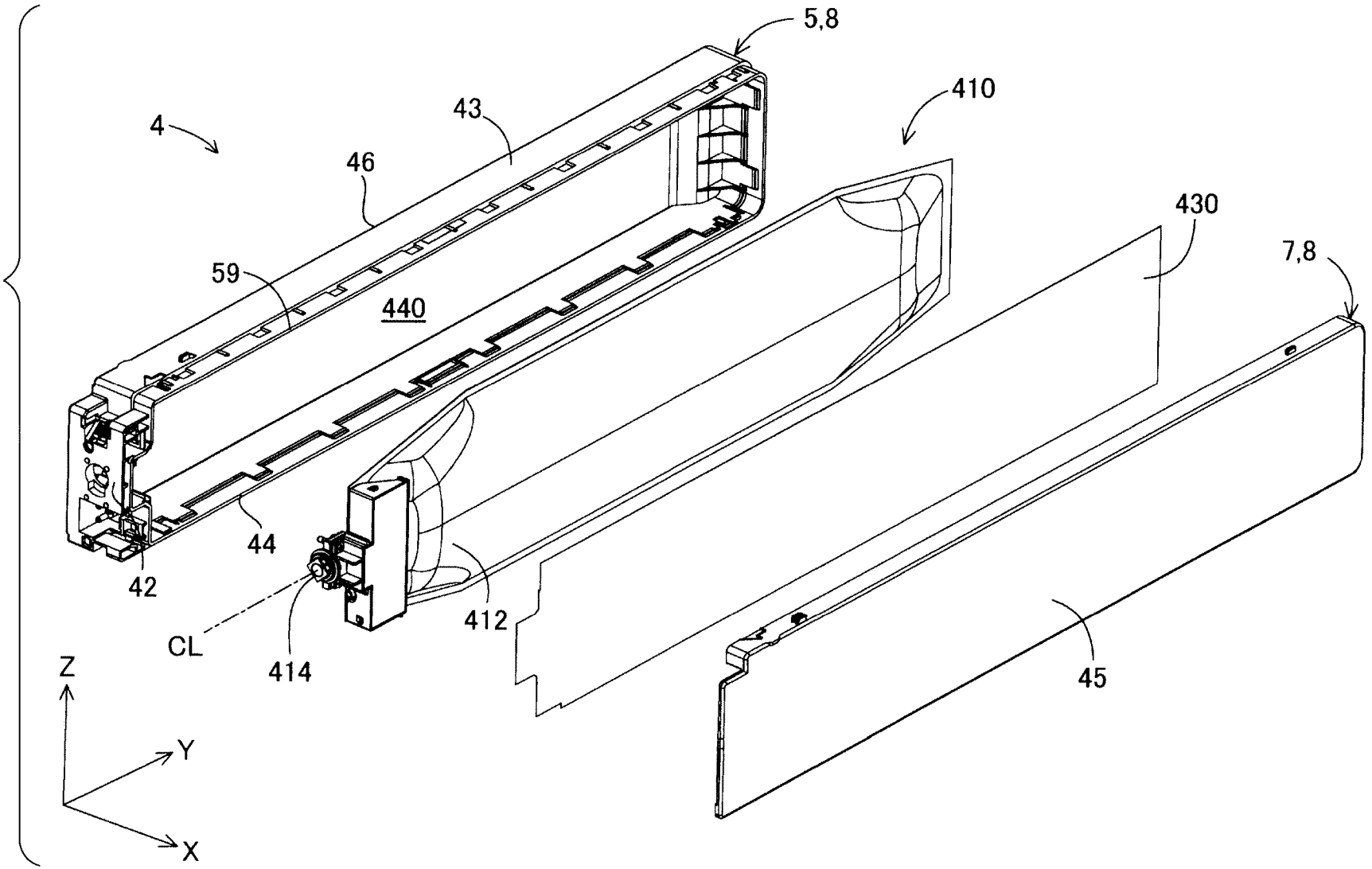
FIG. 5 is an exploded perspective view of the cartridge.

FIG. 4 is perspective view illustrating the outside shape of the cartridge 4. FIG. 5 is an exploded perspective view of the cartridge 4. The cartridge 4 is a liquid container from which an ink can be supplied to the recording head 225 in the printer 20 as a liquid. In FIGS. 4 and 5, the X axis, Y axis, and Z axis are indicated in a state in which the cartridges 4 are installed in the printer 20. In the subsequent drawings as well, the X axis, Y axis, and Z axis are indicated as necessary in a state in which the cartridge 4K is installed in the printer 20. In FIGS. 4 and 5, of the cartridges 4C, 4M, 4Y, and 4K, the structure of the cartridge 4C is illustrated as the structure of the cartridge 4. In this embodiment, the structures of the four cartridges 4C, 4M, 4Y, and 4K are substantially the same. However, the cartridge 4K has a larger width in the X direction than the other cartridges 4C, 4M and 4Y.

The outside shape of the cartridge 4 is a substantially rectangular parallelepiped as illustrated in FIG. 4. Of the dimensions of the cartridge 4, the dimension in the Y direction is smallest, followed by the dimension in the Z direction and the dimension in the X direction in that order. The X direction is also referred to as the width direction of the cartridge 4, and the Z direction is also referred to as the height direction of the cartridge 4. The cartridge 4 has a case 8 forming an outer shell. The case 8 is a cabinet formed by being molded from a polypropylene resin, polystyrene resin, or other synthetic resin.

The cartridge 4 has a front wall 42, a rear wall 47, a top wall 43, a bottom wall 44, a first side wall 45, and a second side wall 46. The cartridge 4 further has a second front wall 41 positioned closer to the rear wall 47 than is the front wall 42. The second front wall 41 and front wall 42 face in the −Y direction, which is the installation direction.

The front wall 42 and rear wall 47 are opposite to each other in the Y direction. The front wall 42 is positioned on the −Y direction side, and the rear wall 47 is positioned on the +Y direction side. The top wall 43 and bottom wall 44 cross the front wall 42 and rear wall 47, and are opposite to each other in the Z direction. The top wall 43 is positioned on the +Z direction side, and the bottom wall 44 is positioned on the −Z direction side. The first side wall 45 and second side wall 46 cross the front wall 42, rear wall 47, top wall 43, and bottom wall 44, and are opposite to each other in the X direction. The first side wall 45 is positioned on the +X direction side, and the second side wall 46 is positioned on the −X direction side. In this specification, when two walls cross each other, this implies any one of a state in which the two walls actually cross each other, a state in which an extension of one of the two walls crosses the other wall, and a state in which extensions of the two walls cross each other.

It can also be said that the front wall 42 is formed at a protrusion 48, which protrudes from the second front wall 41 in the −Y direction. The shape of the front wall 42 is substantially a rectangle having a larger dimension in the Z direction than in the X direction. With the cartridge 4 installed, the front wall 42 faces the apparatus-side front wall portion 62 illustrated in FIG. 3.

The cartridge 4 has a liquid storage body 410 that stores an ink and also has the case 8 in which the liquid storage body 410 is placed, as illustrated in FIG. 5. The state in which the cartridge 4 is installed in the printer 20 is also a state in which the liquid storage body 410 accommodated in the cartridge 4 is installed in the printer 20. The case 8 is composed of a first case 5 and a second case 7. The first case 5 and second case 7 are formed by being molded from a synthetic resin.

The first case 5 has a concave shape having an opening in the +X direction. The first case 5 mainly forms the front wall 42, top wall 43, bottom wall 44, second side wall 46, rear wall 47, second front wall 41, and protrusion 48. A seat member 430 is joined to an end face 59 that defines the opening of the first case 5.

The seat member 430 is formed from a thin film. The seat member 430 is airtightly joined to the end face 59 that defines the opening of the first case 5 so as to seal the opening. When the seat member 430 is airtightly joined to the end face 59, an inner chamber 440 in which a liquid storage section 412 is accommodated is defined. This inner chamber 440 receives a supply of pressurized air that passes through the fluid flow path 227. In the inner chamber 440, the supplied pressurized air presses the liquid storage section 412. Thus, the ink stored in the liquid storage section 412 is pressurized. When the ink in the liquid storage section 412 is pressurized with the cartridge 4 installed, the ink stored in the liquid storage section 412 is supplied to the printer 20. That is, the inner chamber 440 also functions as a pressurizing chamber that pressurizes the ink in the liquid storage section 412 to supply the ink in the liquid storage section 412 to the printer 20.

The second case 7 is attached to the first case 5 so as to cover the seat member 430. The second case 7 mainly forms the first side wall 45. The liquid storage body 410 and seat member 430 are protected by the first case 5 and second case 7, suppressing the liquid storage body 410 and seat member 430 from being damaged.

The liquid storage body 410 has the liquid storage section 412 and a liquid supply section 414. The liquid storage section 412 stores an ink. The liquid storage section 412 is formed from a flexible film. The liquid storage section 412 is in the form of a bag. The volume of the liquid storage section 412 is reduced as the ink in the liquid storage section 412 is consumed. The whole of the liquid storage section 412 may not be formed from a flexible member. At least part of the liquid storage section 412 may be formed from a flexible member.

The liquid supply section 414 can supply an ink from the interior of the liquid storage section 412 to its outside. The liquid supply section 414 allows the ink stored in the liquid storage section 412, which functions as a liquid supply source, to flow toward the printer 20. When the liquid entrance 643 in a tubular shape is inserted into the liquid supply section 414 with the cartridge 4 installed, the liquid supply section 414 and liquid entrance 643 are coupled together. The ink in the liquid storage section 412 flows through the liquid supply section 414 and liquid entrance 643 and into the recording head 225 in the printer 20. The liquid supply section 414 has a central axis CL. The central axis CL extends in parallel to the −Y direction, in which the cartridge 4 is installed. The liquid supply section 414 internally has a tubular member through which an ink can flow. The liquid supply section 414 is coupled to the end of the liquid storage section 412 in the −Y direction. A valve mechanism is provided in the liquid supply section 414. This valve mechanism is opened when the liquid entrance 643 is coupled to the liquid supply section 414.

Figure 6:
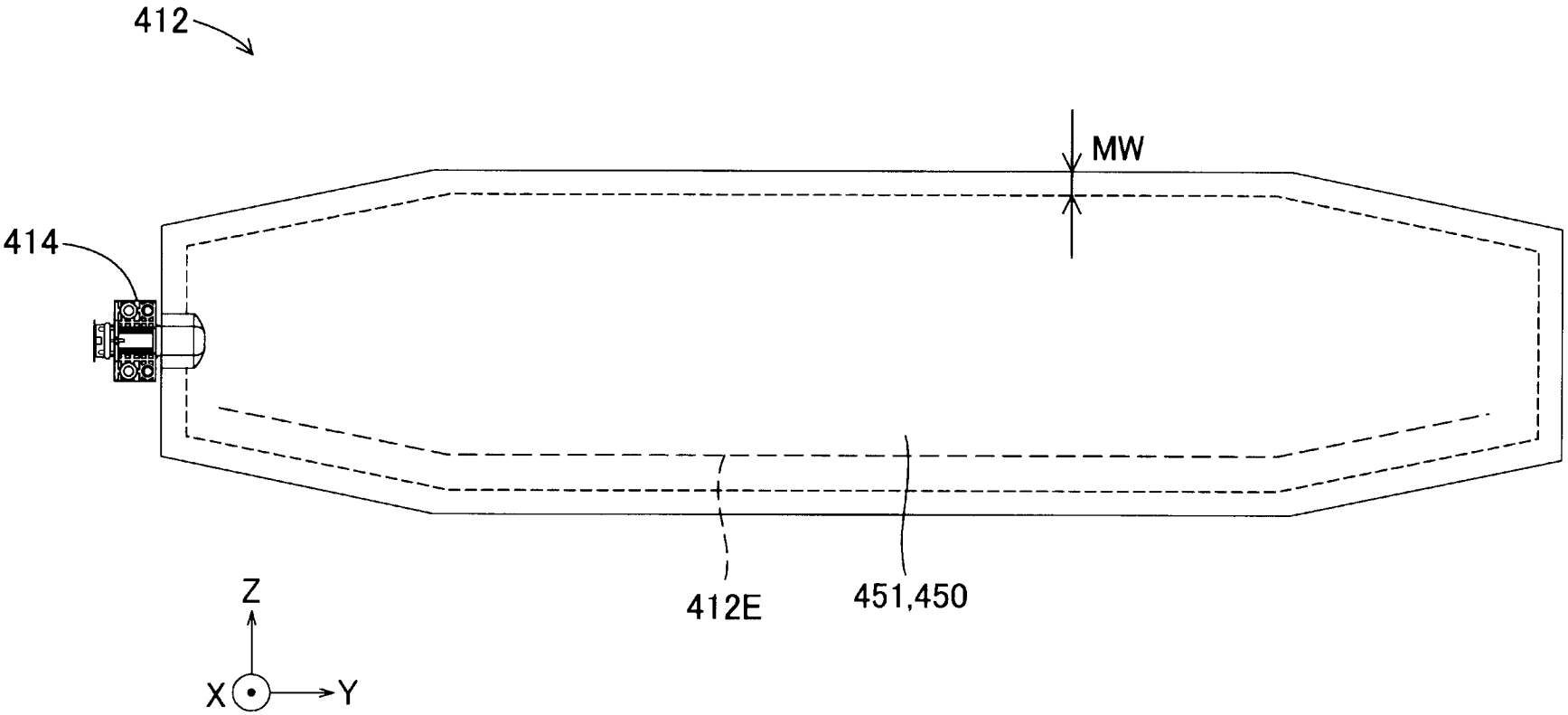
FIG. 6 is a side view of a liquid storage section.
Figure 7:
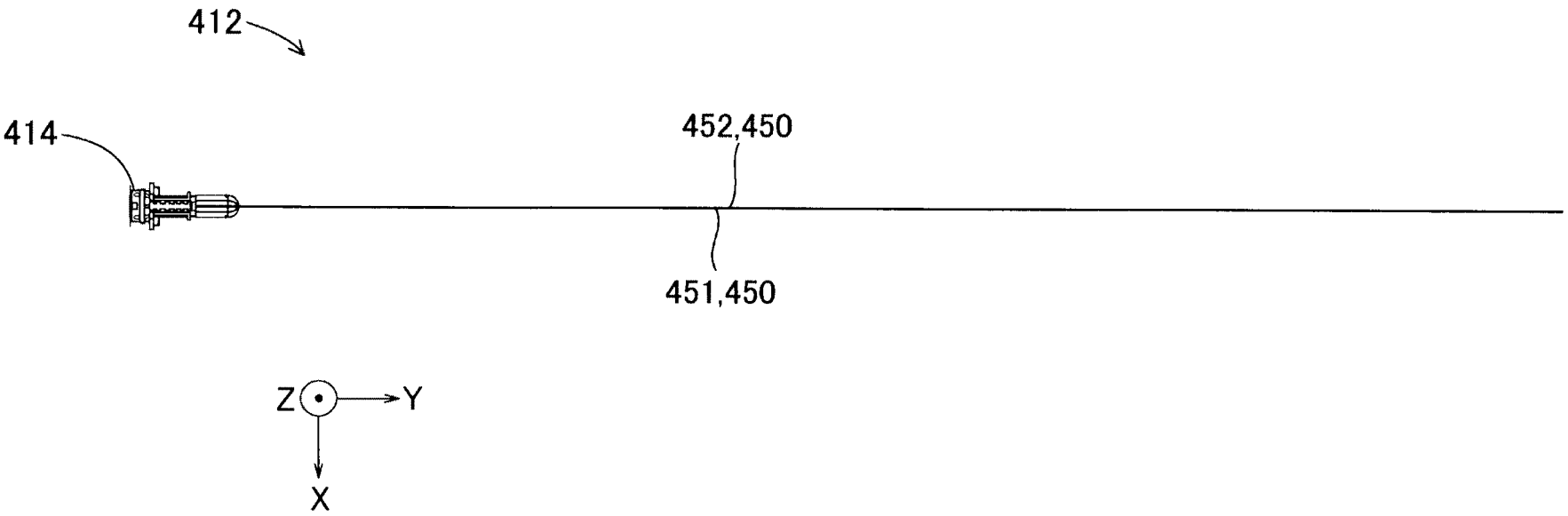
FIG. 7 is a top view of the liquid storage section.
Figure 8:
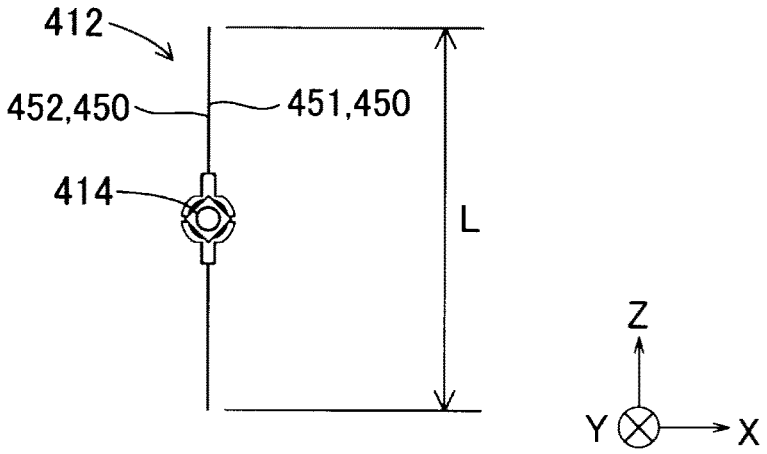
FIG. 8 is a front view of the liquid storage section.

FIG. 6 is a side view of the liquid storage section 412. FIG. 7 is a top view of the liquid storage section 412. FIG. 8 is a front view of the liquid storage section 412. The liquid storage section 412 is formed by joining the ends of two films, a first film 451 and a second film 452, which are opposite to each other in the X direction, by thermal fusion or the like. In this embodiment, the first film 451 and second film 452 have the same shape and are formed from the same material. The width MW of a portion over which the first film 451 and second film 452 are joined together is 4.5 mm. In the description below, when the first film 451 and second film 452 are referred to without a distinction, they will be referred to as a film 450. The liquid storage section 412 has an elongated shape having a larger dimension in the Y direction than in the Z direction. The liquid supply section 414 is attached at the center of an end of the liquid storage section 412, the center being in the Z direction, the end being in the −Y direction, so that the liquid supply section 414 is interposed between the first film 451 and the second film 452. In this embodiment, the liquid storage section 412 has a substantially octagonal shape having a side along the top wall 43 and a side along the bottom wall 44. In other words, the liquid storage section 412 has a shape resulting from cutting the four corners of a quadrangular shape. This shape restrains the four corners of the liquid storage section 412 from protruding in the X direction when the liquid storage section 412 is filled with an ink. With the liquid storage section 412 accommodated in the case 8, therefore, it is possible to restrain the seat member 430 from being damaged by a corner of the liquid storage section 412. The shape of the liquid storage section 412 is not limited to an octagon if the liquid storage section 412 has a side along the top wall 43 and a side along the bottom wall 44. The liquid storage section 412 may have another polygonal shape such as a rectangular or hexagonal shape. Sides other than the side along the top wall 43 and the side along the bottom wall 44 may be curved lines.

Figure 9:
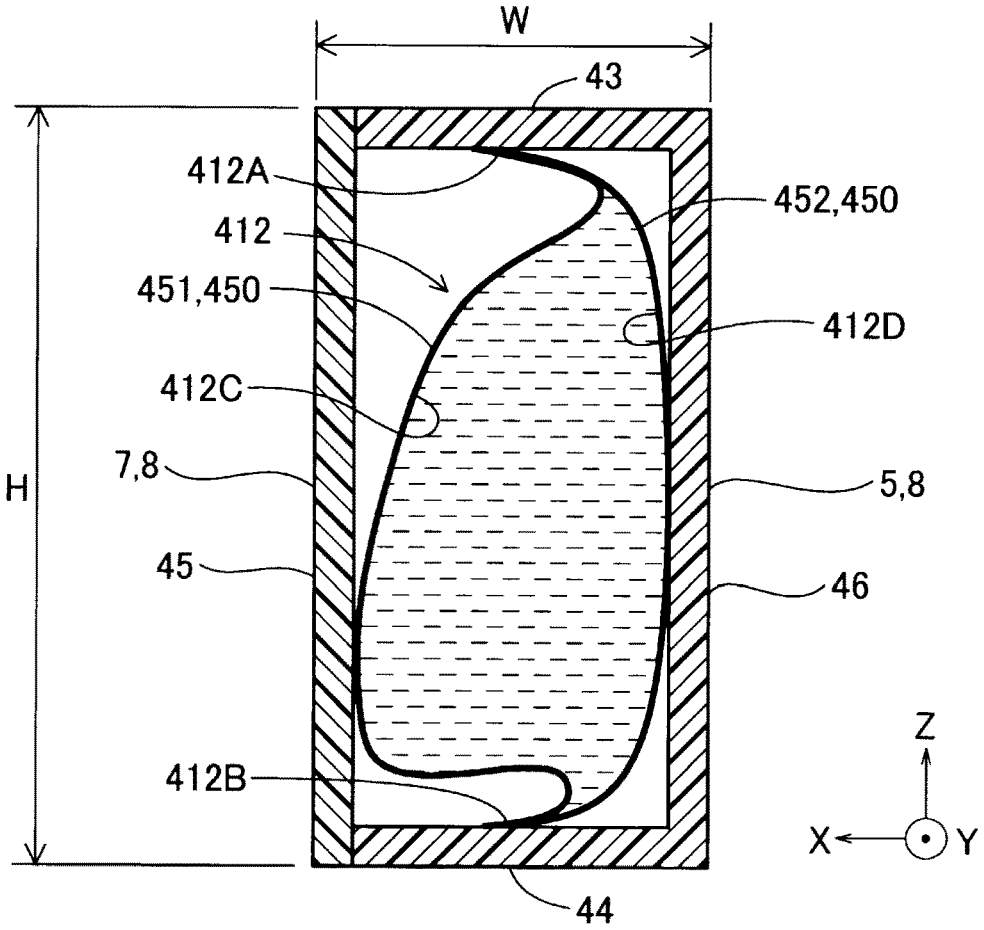
FIG. 9 illustrates a placement of the liquid storage section in a case.

FIG. 9 illustrates a placement of the liquid storage section 412 in the case 8. Specifically, FIG. 9 schematically illustrates an end face of the cartridge 4 in a state in which the liquid storage section 412 is filled with an ink and the liquid storage body 410 is installed in the printer 20. The end face in this schematic drawing is the end face taken along line IX-IX in FIG. 4. In FIG. 9 and later drawings, the seat member 430 is appropriately omitted to simply the drawings. As illustrated in FIG. 9, in a state in which the liquid storage section 412 is filled with an ink and the liquid storage body 410 is installed in the printer 20, at least part of the upper edge 412A of the liquid storage section 412 and at least part of the lower edge 412B of the liquid storage section 412 are in contact with the case 8. In this embodiment, the liquid storage section 412 is substantially octagonal as illustrated in FIG. 6. In this embodiment, therefore, the whole of the upper edge 412A of the liquid storage section 412 is not in contact with the case 8, but only the central portion of the upper edge 412A of the liquid storage section 412 in the Y direction is in contact with case 8. Similarly, the whole of the lower edge 412B of the liquid storage section 412 is not in contact with the case 8, but only the central portion of the lower edge 412B of the liquid storage section 412 in the Y direction is in contact with case 8. When, for example, the liquid storage section 412 is rectangular, the whole of the upper edge 412A of the liquid storage section 412 and the whole of the lower edge 412B of the liquid storage section 412 are in contact with the case 8. On the inner surface of the top wall 43, the upper edge 412A of the liquid storage section 412 comes into contact with the case 8. On the inner surface of the bottom wall 44, the lower edge 412B of the liquid storage section 412 comes into contact with the case 8. In this embodiment, the upper edge 412A and lower edge 412B of the liquid storage section 412 are in contact with the case 8 in a state in which they are curved so as to face in the +X direction toward which the first case 5 is open. With the liquid storage section 412 filled with an ink, a first inner surface 412C of the liquid storage section 412 and its second inner surface 412D opposite to the first inner surface 412C are separated from each other. The first inner surface 412C is the inner surface of the first film 451 disposed on the +X direction side, and the second inner surface 412D is the inner surface of the second film 452 disposed on the −X direction side. With the liquid storage section 412 filled with an ink, the first inner surface 412C is curved so as to be convex in the +X direction toward which the first case 5 is open. The second inner surface 412D is curved so as to be convex toward the second side wall 46, which is a wall of the first case 5 on the −X direction side. The extent to which the first inner surface 412C is convex in the +X direction is larger than the extent to which the second inner surface 412D is convex in the −X direction.

Figure 10:
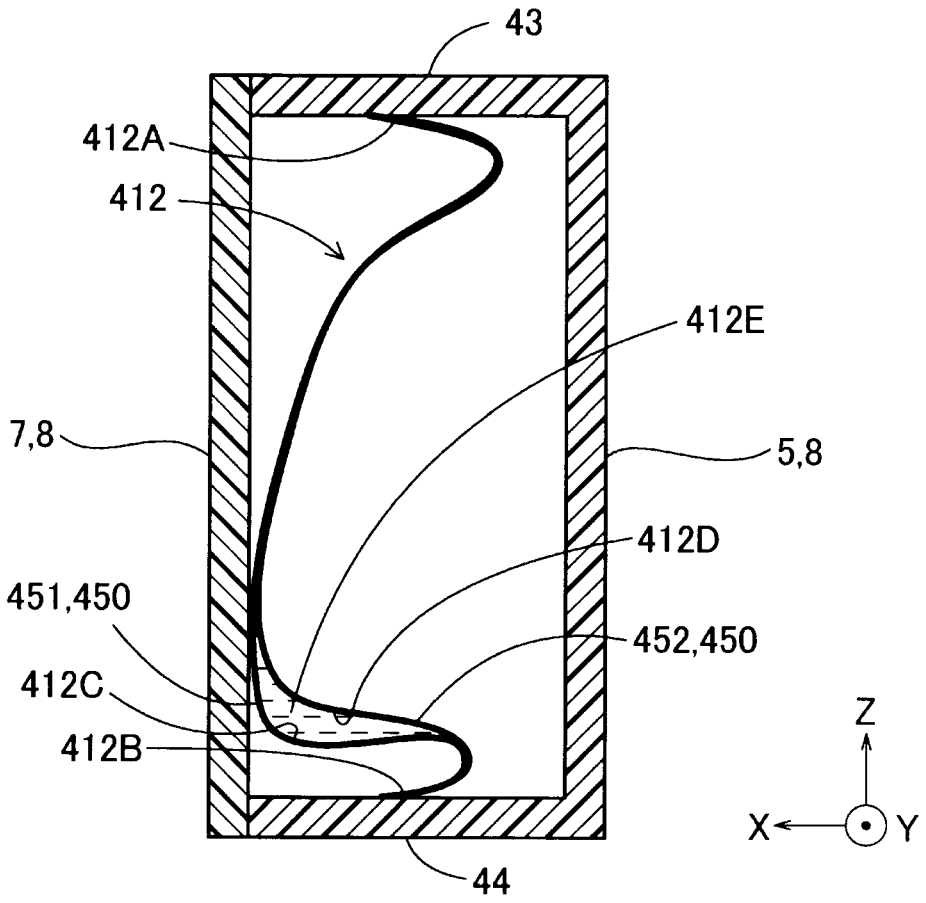
FIG. 10 illustrates another placement of the liquid storage section in the case.

FIG. 10 illustrates another placement of the liquid storage section 412 in the case 8. In FIG. 10, the ink in the liquid storage section 412 has been consumed to a certain extent. As the ink in the liquid storage section 412 is supplied to the printer 20 through the liquid supply section 414, the second inner surface 412D gradually approaches the first inner surface 412C and, at the same time, comes into contact with the first inner surface 412C from top to bottom. The reason why the first inner surface 412C and second inner surface 412D come into contact with each other from top to bottom, the ink is likely to remain at the bottom of the liquid storage section 412 due to the force of gravity of the ink. In this embodiment, the second inner surface 412D approaches the first inner surface 412C along with the supply of the ink while drawing an arc so as to follow the first inner surface 412C. This is because both the upper edge 412A and lower edge 412B of the liquid storage section 412 are bent so as to face in a direction toward which the first inner surface 412C is curved and the curved first inner surface 412C is thereby pressed inwardly from the top wall 43 and bottom wall 44 of the case 8, so the second inner surface 412D is more likely to be deformed toward the first inner surface 412C than is the first inner surface 412C is deformed toward the second inner surface 412D. The shape of the arc drawn by the second inner surface 412D is a substantially S-shape formed by the second inner surface 412D and the lower edge 412B of the liquid storage section 412 when the liquid storage section 412 is viewed from the +Y direction toward the −Y direction. When the second inner surface 412D approaches the first inner surface 412C and, at the same time, comes into contact with the first inner surface 412C from top to bottom, a liquid flow path 412E is formed through which the ink in the liquid storage section 412 flows toward the liquid supply section 414 is formed at the bottom of the interior of the liquid storage section 412. The bottom of the interior of the liquid storage section 412 refers to a portion lower than the center of the liquid storage section 412 in its height direction. Preferably, that portion is immediately above the lower edge 412B. In this embodiment, the liquid flow path 412E is formed along the direction in which the lower edge 412B of the liquid storage section 412 extends. In FIG. 6, the direction in which the liquid flow path 412E extends is indicated. The direction in which the liquid flow path 412E extends is substantially the Y direction.

Figure 11:
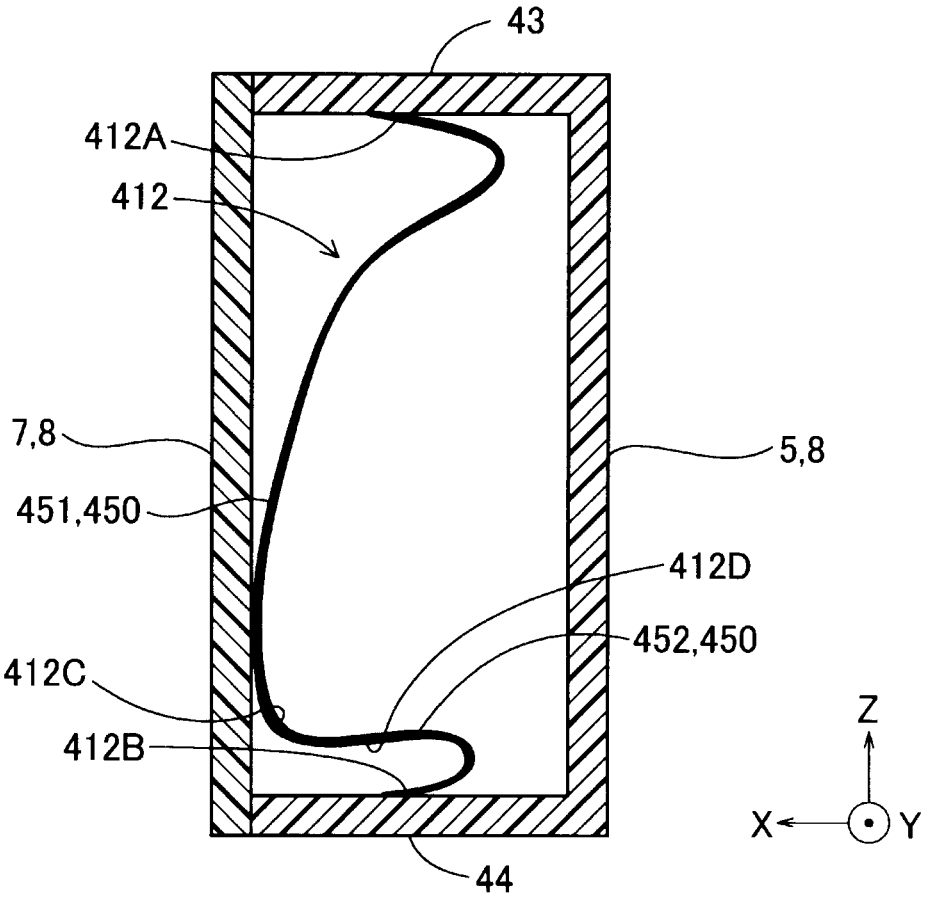
FIG. 11 illustrates yet another placement of the liquid storage section in the case.

FIG. 11 illustrates another placement of the liquid storage section 412 in the case 8. As the ink in the liquid storage section 412 is supplied to the outside of the liquid storage section 412 through the liquid flow path 412E, the volume of the liquid flow path 412E illustrated in FIG. 10 is gradually reduced. Then, as illustrated in FIG. 11, the first inner surface 412C and second inner surface 412D of the liquid storage section 412 come into tight contact with each other and thereby the liquid flow path 412E disappears. Almost all of the ink in the liquid storage section 412 and liquid flow path 412E is discharged to the outside.

In the first embodiment described so far, the second inner surface 412D of the liquid storage section 412 gradually approach its first inner surface 412C as the supply of the ink and, at the same time, comes into contact with the first inner surface 412C from top to bottom. As a result, the liquid flow path 412E is formed at the bottom of the interior of the liquid storage section 412. When the ink is further supplied, the first inner surface 412C and second inner surface 412D come into tight contact with each other, reducing the volume of the liquid flow path 412E. This makes it possible to reduce the amount of ink remaining in the cartridge 4.

In this embodiment, since the liquid flow path 412E is formed as the second inner surface 412D of the liquid storage section 412 comes into contact with its first inner surface 412C from top to bottom, there is no need to provide, in the liquid storage section 412, a special member to form the liquid flow path 412E or to add, to the liquid storage section 412, a special process to form the liquid flow path 412E. This makes it possible to reduce the manufacturing cost of the cartridge 4.

In this embodiment, the second inner surface 412D of the liquid storage section 412 approaches its first inner surface 412C along the supply of the ink while drawing an arc so as to follow the first inner surface 412C. Therefore, it is possible to restrains wrinkles from being created in the liquid storage section 412, so more ink can be collected in the liquid flow path 412E. This makes it possible to more efficiently reduce the amount of ink remaining in the cartridge 4.

In this embodiment, the shape of the arc described above is an S-shape formed by the second inner surface 412D and the lower edge 412B of the liquid storage section 412. When, for example, the arc described above has a horizontal U-shape, the whole of the liquid storage section 412 is likely to shrink and wrinkle. Since, in this embodiment, the arc has an S-shape, however, the liquid storage section 412 is likely to shrink from top to bottom, making it difficult for the liquid storage section 412 to wrinkle. Therefore, more ink can be collected in the liquid flow path 412E. This makes it possible to more efficiently reduce the amount of ink remaining in the liquid container.

In this embodiment, the liquid flow path 412E is formed along the direction in which the lower edge 412B of the liquid storage section 412 extends. Therefore, ink that is present in a portion, in the liquid storage section 412, opposite to the liquid supply section 414 can also be led easily to the liquid supply section 414. This makes it possible to more efficiently reduce the amount of remaining ink.

FIG. 12 indicates preferable relationships of dimensions that the film 450 and case 8 take. A plurality of cartridges 4 in which the film 450 and case 8 had different dimensions were prepared. For each cartridge 4, the amount of remaining ink was measured when an ink end was detected in the printer 20 and, at that time, the state of the deformed liquid storage section 412 was observed. FIG. 12 indicates measurement results and observation results. In FIG. 12, "film length ratio" is the ratio of the sum of the width W of the case 8 and the height H of the case 8 to the length L of the film 450 in the height direction of the case 8. The length L of the film 450 in the height direction of the case 8 was measured when the liquid storage section 412 stored no ink and was thereby flat along the Z direction as illustrated in FIG. 8. That is, the length L was measured along the outer surface of the liquid storage section 412 in the Z direction. The width W of the case 8 was the dimension of the case 8 along the X direction as illustrated in FIG. 9. The height H of the case 8 was the dimension of the case 8 along the Z direction.

In FIG. 12, "black" indicates that a cartridge 4 in which a black ink was stored was used and "color" indicates that a cartridge 4 in which a color ink was stored was used. The horizontal arrangement of "black" and "color" indicates that the liquid storage sections 412 of these inks had the same dimensions but their relevant cases 8 had different dimensions. A hyphen (-) in FIG. 12 indicates that measurement or observation was not performed. In the measurement results of the amount of remaining ink, B indicates that the amount of remaining ink was equal to or more than a reference weight equivalent to 1% of the volume of the liquid storage section 412, and A indicates that the amount of remaining ink was less than the reference weight.

Figure 13:
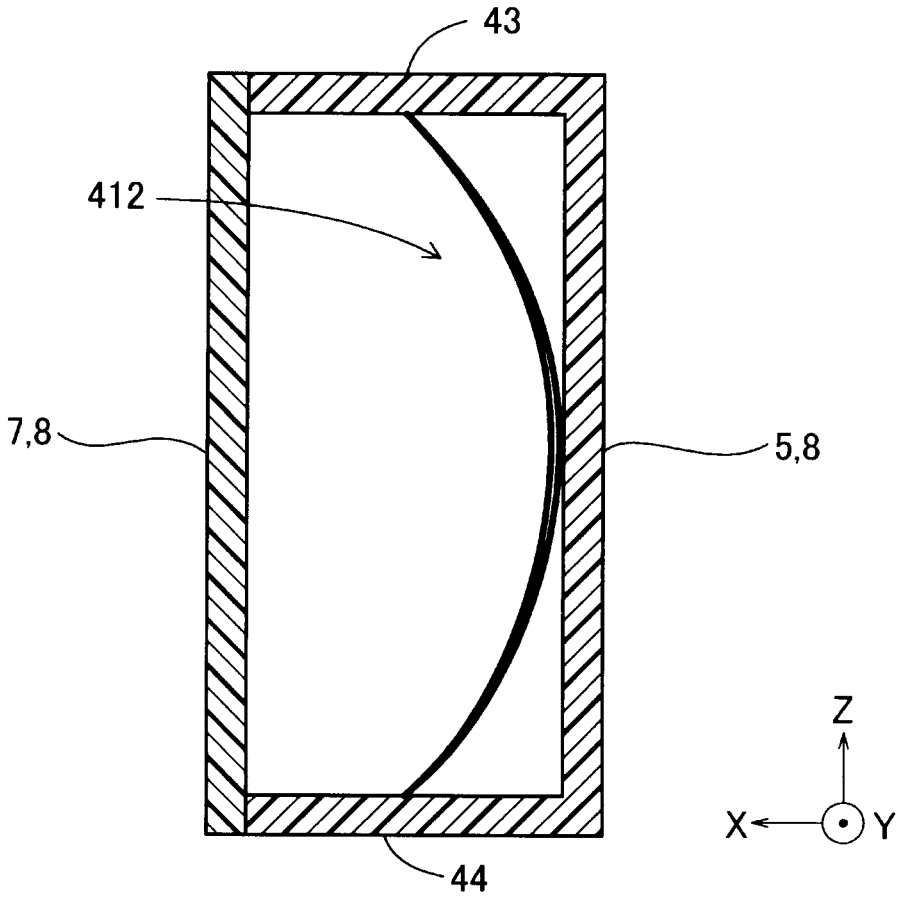
FIG. 13 illustrates an aspect in which the liquid storage section is horizontally U-shaped.
Figure 14:
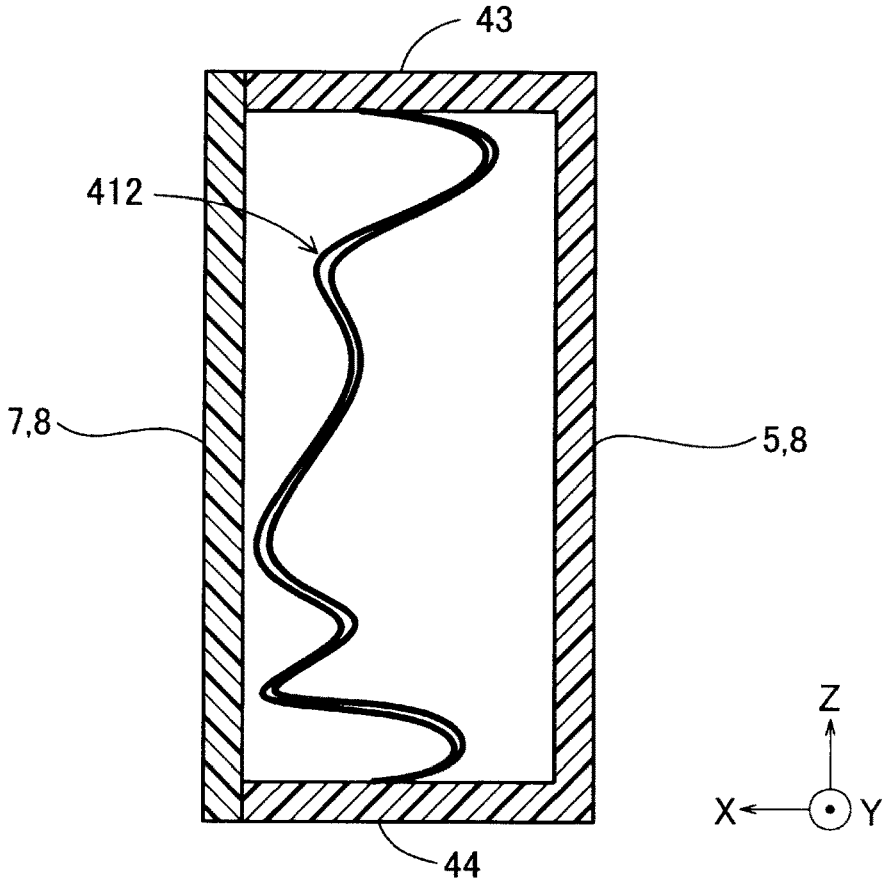
FIG. 14 illustrates in a state in which the entire liquid storage section wrinkles.

In the observation results of the deformed state in FIG. 12, a hyphen (-) indicates that observation was not performed, "U-shape" indicates that the liquid storage section 412 was deformed into a horizontal U-shape as illustrated in FIG. 13, "S-shape" indicates that the liquid storage section 412 was deformed as illustrated in FIG. 11, as assumed in this embodiment, and "S-shape and wrinkles" indicates a state in which part of the liquid storage section 412 was deformed into an S-shape but wrinkles were formed as a whole as illustrated in FIG. 14. With the cartridges 4 in which the liquid storage section 412 was classified as "U-shape", the upper and lower edges of the liquid storage section 412 respectively abutted the top wall 43 and bottom wall 44 of the case 8 because the length L of the liquid storage section 412 in the height direction was short. As a result, wrinkles were formed in the liquid storage section 412, so ink equal to or more than a reference remaining amount was left. With the cartridges 4 in which the liquid storage section 412 was classified as "S-shape and wrinkles", the length L of the liquid storage section 412 in the height direction was too long for the liquid storage section 412 to fit to the interior of the case 8 and the liquid storage section 412 could not be completely stretched in the height direction. As a result, many wrinkles were formed in the liquid storage section 412, so ink equal to or more than the reference remaining amount was left.

Of the cartridges 4 in black and the cartridges 4 in color, the film length ratios of cartridges 4 for which the amount of remaining ink was less than the standard weight and deformation was in an S-shape were within a range of 0.98 to 1.23, as illustrated in FIG. 12. In this embodiment, therefore, it is preferable for the dimensions of the case 8 and liquid storage section 412 to have been set so that the film length ratio falls into this range. When the film length ratio is within this range, the film 450 is pressed by the case 8 under substantially constant pressure, so the first film 451 can be kept warped as illustrated in FIG. 9 up to the last. This makes it possible to reduce the amount of remaining ink.

B. Second Embodiment

Figure 15:
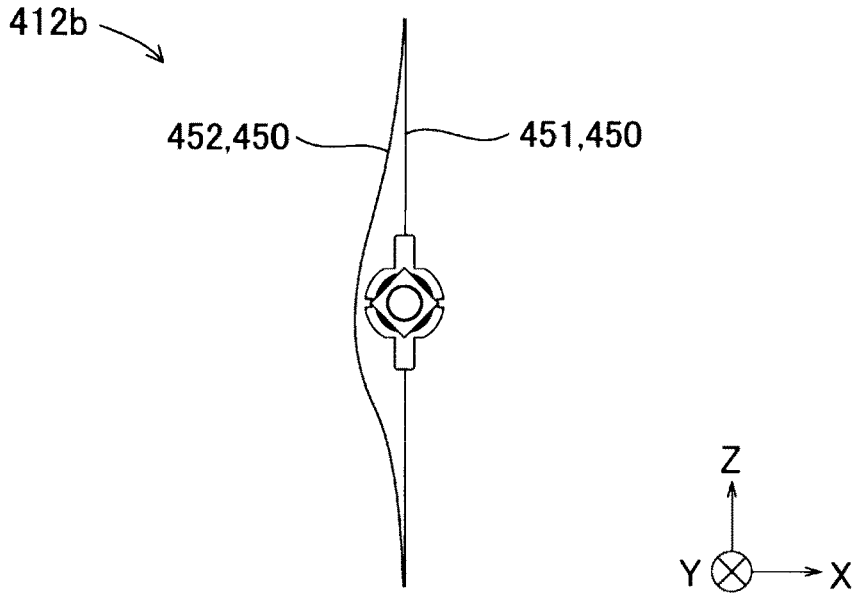
FIG. 15 illustrates the shape of a liquid storage section in a second embodiment.

FIG. 15 illustrates the shape of a liquid storage section 412*b* in a second embodiment. In the first embodiment, the two films 450 constituting the liquid storage section 412 have had the same shape. In the second embodiment, however, the length of one of the two films 450, the length being along the surface in the Z direction, is longer than the length of the other film 450. In this aspect, since either film 450 has an extra portion caused by the different lengths, the liquid flow path 412E can be easily formed. This makes it possible to reduce the amount of ink remaining in the cartridge 4. In this embodiment, the film length ratio of the film 450 having a shorter length in the Z direction is preferably within a range of 0.98 to 1.23.

C. Third Embodiment

Figure 16:
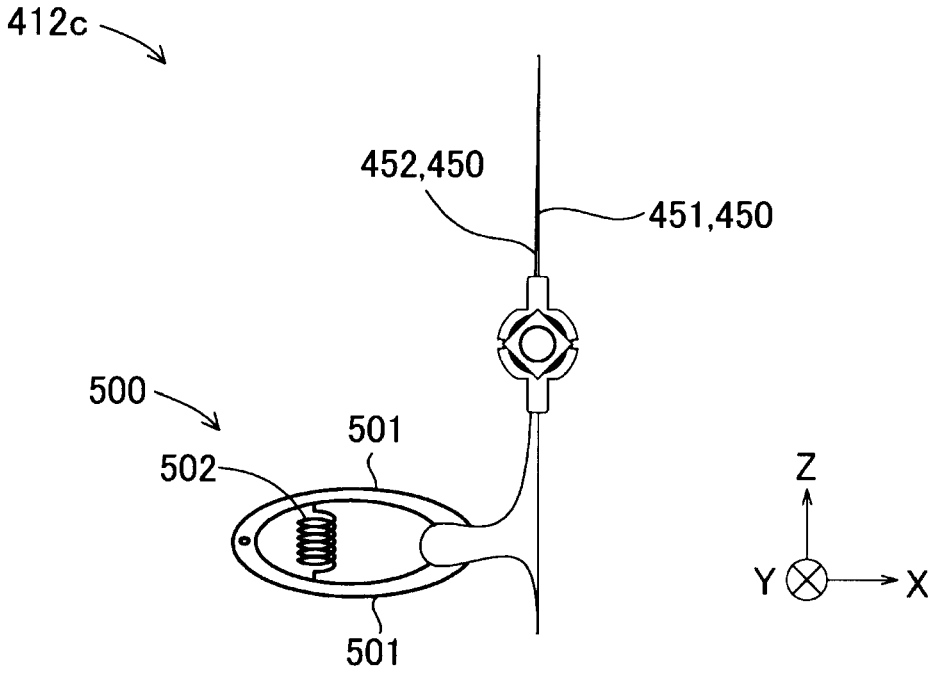
FIG. 16 illustrates the shape of a liquid storage section in a third embodiment.

FIG. 16 illustrates the shape of a liquid storage section 412*c* in a third embodiment. In the first embodiment, the two films 450 constituting the liquid storage section 412 have had the same shape. In the third embodiment, however, at least one of the two films 450 opposite to each other has a knob section 500 that holds the film 450 and warps it toward the outside of the liquid storage section 412*c*. The knob section 500 has, for example, a pair of knob members 501 that interpose the film 450 from opposing sides in the Z direction and also has an urging member 502 that urges the pair of knob members 501 in a direction in which they approach each other. In this aspect, when the film 450 is held by the knob section 500, the liquid flow path 412E can be easily formed. This makes it possible to reduce the amount of ink remaining in the cartridge 4. The two films 450 constituting the liquid storage section 412*c* may have the same shape. Alternatively, the film 450 having the knob section 500 may be longer in the height direction than the other film 450. The position at which the film 450 is held is preferably at a lower portion of the liquid storage section 412*c*.

D. Fourth Embodiment

In the first embodiment, the two films 450 constituting the liquid storage section 412 have had the same shape and had been formed from the same material. In a fourth embodiment, however, the stiffness of one of the opposing films 450 is lower than the stiffness of the other film 450. In this aspect, by use of the film 450 that has low stiffness and is thereby more easily deformed, the liquid flow path 412E can be easily formed. This makes it possible to reduce the amount of ink remaining in the cartridge 4. To make a difference in stiffness between the two films 450, they can be formed from, for example, different materials. When, for example, the first film 451 and second film 452 are each formed as a multi-layer film, a difference in stiffness can be made between the first film 451 and the second film 452 by making a difference between their layer structures. When, for example, one of the two films 450 is formed by laminating a polyethylene layer, a nylon layer, an aluminum layer, and a nylon layer in that order from the inside, it is possible to make a difference in stiffness between the two films 450 by, for example, changing the thickness of at least one layer in the other film 450 or providing another layer between any two layers in the other film 450. Alternatively, a sheet-like film member may be attached to the surface of one of the two films 450 having the same structure to make a difference in stiffness between the two films 450. In the height direction, the two films 450 may have the same length or may have different lengths. When, for example, the film 450, of the two films 450, that has lower stiffness is made longer in the height direction, the liquid flow path 412E can be easily formed.

E. Other Embodiments (E-1) In the above embodiments, the liquid storage section 412 has been formed like a bag by joining the edges of two films 450 together. However, the liquid storage section 412 may be formed by folding a single film and by joining the edges, other than the folded edge, of the film. It is preferable for the folded edge to be opposite to an edge to which the liquid supply section 414 is attached.

(E-2) In the above embodiments, an uneven portion may be formed on the inner surface of at least one of the two films 450 constituting the liquid storage section 412. In this aspect, the first inner surface 412C and second inner surface 412D are not easily come into tight contact with each other, suppressing winkles. This makes it possible to reduce the amount of remaining ink. The uneven portion can be formed by, for example, press molding.

(E-3) In the above embodiments, the lower portion of the surface of one of the films 450 constituting the liquid storage section 412 may be bonded to the inner surface of the case 8 or seat member 430. Then, the liquid flow path 412E can be easily formed. This makes it possible to efficiently reduce the amount of remaining ink.

(E-4) In the above embodiments, the second inner surface 412D of the liquid storage section 412 has approached its first inner surface 412C along with the supply of ink while drawing an arc so as to follow the first inner surface 412C. However, the first inner surface 412C may approach the second inner surface 412D while drawing an arc so as to follow the second inner surface 412D. Also, since the second inner surface 412D or first inner surface 412C only needs to come into contact with its counterpart from top to bottom, the first inner surface 412C or second inner surface 412D may approach the counterpart so as to draw a straight line.

(E-5) In the above embodiments, the liquid flow path 412E has been formed along the direction in which the lower edge 412B of the liquid storage section 412 extends. However, for example, the liquid flow path 412E may be formed at the lower portion of the interior of the liquid storage section 412 in a diagonal direction or may be formed in a curved shape so as to draw an arc.

(E-6) In the above embodiments, four types of cartridges 4 have been installed in the printer 20. However, the printer 20 may be structured so that one to three types or five or more types of cartridges 4 can be installed.

(E-7) The present disclosure is not limited to printers and their cartridges, but can also be applied to arbitrary liquid ejecting apparatuses that consume a liquid other than inks and to liquid containers used in these liquid ejecting apparatuses. For example, the present disclosure can be applied as a liquid container used in various types of liquid ejecting apparatuses as described below.

(1) Image recording apparatuses such as facsimile machines (2) Color material ejecting apparatuses used to manufacture color filters for use in image display apparatuses such as liquid crystal displays (3) Electrode material ejecting apparatuses used to form electrodes in electroluminescence (EL) displays, field emission displays (FEDs), and the like (4) Liquid electing apparatuses that eject a liquid including bio-organic substances used in the manufacturing of biochips (5) Sample ejecting apparatuses used as precise pipettes (6) Lubricant ejecting apparatuses (7) Resin solution ejecting apparatuses (8) Liquid ejecting apparatuses that eject a lubricant to a clock, a camera, or another precision machine at a particular point (9) Liquid ejecting apparatuses that eject a transparent resin solution such as an ultraviolet curable resin solution to a substrate to form a minute hemispherical lens (optical lens) or the like used in an optical communication element or the like

(10) Liquid ejecting apparatuses that eject an acidic or alkaline etching solution to etch a substrate or the like

(11) Liquid ejecting apparatuses having a liquid ejecting head that expels a very small amount of any other droplets The term "droplet" refers to a liquid expelled from a liquid ejecting apparatus in one of various states. Droplets in these states include a droplet in a granular state, a tear-like droplet, and a droplet tailing like a string. The liquid referred to here only needs to be a material that a liquid ejecting apparatus can consume. For example, the liquid may be a material in a state in which the substance is in a liquid phase. Examples of liquid materials included in liquids are liquid materials having high viscosity or low viscosity, inorganic solvents such as sols, gel water, and the like, organic solvents, solutions, liquid resins, and liquid metals (metallic melts). Not only liquids, which are in one state of substances, but also solvents in which particles of a functional material composed of pigments, metal particles, or another solid are dissolved, dispersed, or mixed are also included in liquids. Typical examples of liquids include liquid crystals and inks described in the above embodiments. Inks referred to here include ordinary water-based inks and oil-based inks as well as various liquid compositions such as gel inks and hot melt inks.

F. Other Aspects

The present disclosure is not limited to the embodiments described above; the present disclosure can be implemented in various structures without departing from the intended scope of the present disclosure. For example, technical features, in the above embodiments, corresponding to technical features in the aspects described below can be appropriately replaced or combined to solve part or all of the problems described above or achieve part or all of the effects described above. When these technical features are not described in this specification as being essential, the technical features can be appropriately deleted.

(1) A first aspect of the present disclosure provides a liquid container from which a liquid can be supplied to a liquid ejecting head in a liquid ejecting apparatus. This liquid container has a liquid storage body that stores the liquid and also has a case that stores the liquid storage body. The liquid storage body has a liquid storage section formed like a bag by joining the edges of opposing films together and also has a liquid supply section that can supply the liquid from the interior of the liquid storage section to its outside. In a state in which the liquid storage section is filled with the liquid and the liquid storage body is installed in the liquid ejecting apparatus, at least part of the upper edge of the liquid storage section and at least part of the lower edge of the liquid storage section are in contact with the case and a first inner surface of the liquid storage section and its second inner surface opposite to the first inner surface are separated from each other. The liquid storage section is structured so that as the liquid is supplied, the first inner surface and second inner surface gradually approach each other and, at the same time, come into contact with each other from top to bottom, forming, at the bottom of the interior of the liquid storage section, a liquid flow path through which the liquid flows from the liquid storage section to the liquid supply section.

With the liquid container in this aspect, as the liquid is supplied, the first inner surface and second inner surface of the liquid storage section gradually approach each other and, at the same time, come into contact with each other from top to bottom, so a liquid flow path is formed at the bottom of the interior of the liquid storage section. When the liquid is further supplied, the first inner surface and second inner surface come into tight contact with each other and the volume of the liquid flow path is thereby reduced. This makes it possible to reduce the amount of liquid remaining in the liquid container.

(2) In the liquid container in the above aspect, the second inner surface may approach the first inner surface along with the supply of the liquid while drawing an arc so as to follow the first inner surface. In this aspect, it is possible to restrain wrinkles from being created in the liquid storage section, so more liquid can be collected in the liquid flow path. This makes it possible to more efficiently reduce the amount of ink remaining in the liquid container.

(3) In the liquid container in the above aspect, the shape of the arc may be an S-shape formed by the second inner surface and the lower edge of the liquid storage section. In this aspect, the liquid storage section is likely to shrink from top to bottom, making it difficult for the liquid storage section to wrinkle. Therefore, more liquid can be collected in the liquid flow path. This makes is possible to more efficiently reduce the amount of liquid remaining in the liquid container.

(4) In the liquid container in the above aspect, the liquid flow path may be formed along the direction in which the lower edge of the liquid storage section extends. In this aspect, liquid that is present in a portion, in the liquid storage section, opposite to the liquid supply section can also be led easily to the liquid supply section. This makes it possible to more efficiently reduce the amount of remaining liquid.

(5) In the liquid container in the above aspect, the ratio of the sum of the width of the case and the height of the case to the length of the film in the height direction of the case may be within a range of 0.98 to 1.23. In this aspect, the film can be kept warped in the case. This makes it possible to more efficiently reduce the amount of liquid remaining in the liquid container.

(6) In the liquid container in the above aspect, the length of one of the opposing films, the length being in the height direction of the case, may be longer than the length of the other film, the length being in the height direction of the case. In this aspect, since either film has an extra portion caused by the different lengths, a liquid flow path can be easily formed. This makes it possible to more efficiently reduce the amount of ink remaining in the liquid container.

(7) In the liquid container in the above aspect, the stiffness of one of the opposing films is lower than the stiffness of the other film. In this aspect, by use of the film that has low stiffness and is thereby more easily deformed, the liquid flow path can be easily formed. This makes it possible to more efficiently reduce the amount of ink remaining in the liquid container.

(8) In the liquid container in the above aspect, at least one of the opposing films may have a knob section that holds the film and warps it toward the outside of the liquid storage section. In this aspect, the use of the knob section enables the liquid flow path to be easily formed. This makes it possible to more efficiently reduce the amount of ink remaining in the liquid container.

(9) A second aspect of the present disclosure provides a liquid ejecting apparatus. This liquid ejecting apparatus has the liquid container in any one of the liquid containers described in the above embodiments and also has a liquid ejecting head that ejects the liquid supplied from the liquid container. The liquid ejecting apparatus in this aspect can reduce the amount of ink remaining in the liquid container.

The present disclosure is not limited to aspects implemented as the liquid container and liquid ejecting apparatus described above, but can be implemented as other various aspects including a method of supplying a liquid.

What is claimed is:

1. A liquid container from which a liquid is capable of being supplied to a liquid ejecting head in a liquid ejecting apparatus, the liquid container comprising:

a liquid storage body configured to store the liquid, the liquid storage body including:

a liquid storage section formed as a bag by joining edges of opposing films together, and a liquid supply section configured to supply the liquid from an interior of the liquid storage section to an outside of the liquid storage section; and a case configured to store the liquid storage body; wherein:

in a state in which the liquid storage section is filled with the liquid and the liquid storage body is installed in the liquid ejecting apparatus, at least part of an upper edge of the liquid storage section and at least part of a lower edge of the liquid storage section are in contact with the case and a first inner surface of the liquid storage section and a second inner surface of the liquid storage section, the second inner surface being opposite to the first inner surface, are mutually separated, and the liquid storage section is structured so that as the liquid is supplied, the first inner surface and the second inner surface gradually come close together and, at the same time, come into mutual contact from top to bottom, forming: (a) an approximate S-shape, and (b) a liquid flow path from a bottom of the interior of the liquid storage section through which the liquid flows from the liquid storage section to the liquid supply section.

2. The liquid container according to claim 1, wherein the second inner surface approaches the first inner surface along with supply of the liquid while drawing an arc so as to follow the first inner surface.

3. The liquid container according to claim 2, wherein a shape of the arc is an S-shape formed by the second inner surface and a lower edge of the liquid storage section.

4. The liquid container according to claim 1, wherein the liquid flow path is formed along a direction in which the lower edge of the liquid storage section extends.

5. The liquid container according to claim 1, wherein a ratio of a sum of a width of the case and a height of the case to a length of the film in a height direction of the case is within a range of 0.98 to 1.23.

6. The liquid container according to claim 1, wherein a length of one of the opposing films, the length being in a height direction of the case, is longer than a length of another of the opposing films, the length being in the height direction of the case.

7. The liquid container according to claim 1, wherein stiffness of one of the opposing films is lower than stiffness of another of the opposing films.

8. The liquid container according to claim 1, wherein at least one of the opposing films has a knob section that holds the film and warps the film toward the outside of the liquid storage section.

9. A liquid ejecting apparatus comprising:

the liquid container in claim 1; and a liquid ejecting head that ejects the liquid supplied from the liquid container.

* * * * *